US010555080B2

(12) United States Patent
Truong et al.

(10) Patent No.: US 10,555,080 B2
(45) Date of Patent: Feb. 4, 2020

(54) ACOUSTIC PERIMETER FOR REDUCING NOISE TRANSMITTED BY A COMMUNICATION DEVICE IN AN OPEN-PLAN ENVIRONMENT

(71) Applicant: Polycom, Inc., San Jose, CA (US)

(72) Inventors: Kwan K. Truong, Johns Creek, GA (US); Peter L. Chu, Lexington, MA (US); Steven L. Potts, Andover, MA (US); Eric Elias, Brookline, MA (US)

(73) Assignee: Polycom, Inc., San Jose, CA (US)

( * ) Notice: Subject to any disclaimer, the term of this patent is extended or adjusted under 35 U.S.C. 154(b) by 0 days.

(21) Appl. No.: 16/376,904

(22) Filed: Apr. 5, 2019

(65) Prior Publication Data

US 2019/0238978 A1 Aug. 1, 2019

Related U.S. Application Data

(62) Division of application No. 14/304,903, filed on Jun. 14, 2014, now abandoned.

(51) Int. Cl.
*H04R 3/00* (2006.01)
*H04R 27/00* (2006.01)
*G10L 21/0216* (2013.01)

(52) U.S. Cl.
CPC .... *H04R 3/005* (2013.01); *G10L 2021/02165* (2013.01); *G10L 2021/02166* (2013.01);
(Continued)

(58) Field of Classification Search
CPC .... H04R 3/005; H04R 2410/05; H04R 27/00; H04R 2227/009; G10L 21/0208; G10L 2021/02165; G10L 2021/02166
See application file for complete search history.

(56) References Cited

U.S. PATENT DOCUMENTS 3,755,625 A 8/1973 Maston
6,084,973 A 7/2000 Green et al.
(Continued)

FOREIGN PATENT DOCUMENTS

EP 1914726 A1 4/2008
WO 2006066618 A1 6/2006

OTHER PUBLICATIONS

Int'l Search Report and Written Opinion received in copending PCT Application No. PCT/US15/35536, dated Oct. 23, 2015, 27 pages.
(Continued)

*Primary Examiner* — Yogeshkumar Patel
(74) *Attorney, Agent, or Firm* — Blank Rome, LLP

(57) ABSTRACT

The amount of far-field noise transmitted by a primary communication device in an open-plan office environment is reduced by defining an acoustic perimeter of reference microphones around the primary device. Reference microphones generate a reference audio input including far-field noise in the proximity of the primary device. The primary device generates a main audio input including the voice of the primary speaker as well as background noise. Reference audio input is compared to main audio input to identify the background noise portion of the main audio signal. A noise reduction algorithm suppresses the identified background noise in the main audio signal. The one or more reference microphones defining the acoustic perimeter may be included in separate microphone devices placed in proximity to the main desktop phone, microphones within other nearby desktop telephone devices, or a combination of both types of devices.

20 Claims, 8 Drawing Sheets

(52) U.S. Cl.
CPC ..... *H04R 27/00* (2013.01); *H04R 2227/001* (2013.01); *H04R 2410/05* (2013.01)

(56) References Cited

U.S. PATENT DOCUMENTS

| | | | | |
|---|---|---|---|---|
| 2007/0297620 | A1 | 12/2007 | Choy | |
| 2009/0060216 | A1* | 3/2009 | Sweeney | G10K 11/178 381/71.2 |
| 2009/0323925 | A1 | 12/2009 | Sweeney et al. | |
| 2010/0017205 | A1* | 1/2010 | Visser | G10L 19/00 704/225 |
| 2010/0135481 | A1 | 6/2010 | Frauenthal et al. | |
| 2011/0111805 | A1 | 5/2011 | Paquier et al. | |
| 2011/0182436 | A1 | 7/2011 | Murgia et al. | |
| 2011/0288858 | A1 | 11/2011 | Gay et al. | |
| 2013/0034243 | A1* | 2/2013 | Yermeche | G10K 11/178 381/94.1 |
| 2013/0073283 | A1 | 3/2013 | Yamabe | |
| 2014/0086423 | A1* | 3/2014 | Domingo Yaguez | H04R 3/005 381/58 |
| 2014/0148224 | A1* | 5/2014 | Truong | H04M 9/085 455/557 |

OTHER PUBLICATIONS

European Search Report received in copending EP Application No. 15806171.3, dated Nov. 7, 2017, 8 pages.
USPTO Decision on Appeal received in copending U.S. Appl. No. 14/304,903, dated Nov. 29, 2018, 5 pages.
USPTO Decision on Reconsideration received in copending U.S. Appl. No. 14/304,903, dated Feb. 15, 2019, 4 pages.

* cited by examiner

ACOUSTIC PERIMETER FOR REDUCING NOISE TRANSMITTED BY A COMMUNICATION DEVICE IN AN OPEN-PLAN ENVIRONMENT

CROSS-REFERENCE TO RELATED APPLICATIONS

This application is a divisional of U.S. application Ser. No. 14/304,903, entitled "Acoustic Perimeter for Reducing Noise Transmitted by a Communication Device in an Open-Plan Environment," filed Jun. 14, 2104, by Kwan K. Truong, et al., which is fully incorporated by reference herein.

The subject matter of this application is related to the subject matter of co-pending U.S. patent application Ser. No. 16/376,890, entitled "Acoustic Perimeter for Reducing Noise Transmitted by a Communication Device in an Open-Plan Environment," filed concurrently herewith, by Kwan K. Truong, et al., which is fully incorporated by reference herein.

The subject matter of this application is related to the subject matter of U.S. Pat. No. 8,989,815, filed on Nov. 12, 2012, by Kwan K. Truong, et al., entitled "Far Field Noise Suppression for Telephony Devices," which is fully incorporated by reference herein.

BACKGROUND OF THE INVENTION

1. Field of the Invention

The present invention relates generally to communication systems, and more particularly to systems, methods, and devices for improving noise reduction.

2. Description of the Related Art

Open-plan office configurations are popular due to the potential to foster a cooperative and interactive work environment. In addition, open-plan offices may allow overhead savings due to, for example, reduction in total office square-footage as compared to that required for enclosed offices and build-out cost savings though use of cubicles and partitions in lieu of walls.

However, such open-office configurations afford little sound isolation between individual desks and workstations, allowing conversations, office equipment, HVAC noise, etc. to reach workers at their desks. Such far-field noise (background sound and noise) can be especially problematic in situations where workers engage in telephone conversations at their open-plan work stations. Such far-field noise can be transmitted along with a worker's conversation, leading to poor communication and confidentiality concerns.

Desktop telephone systems have become a ubiquitous communications tool in a wide variety of offices and call centers. Such communication systems may include desktop video phones and desktop conferencing systems. Desktop systems typically support a variety of communication modes, such as via hand set, head set, or hands-free speaker phone. The speakerphone function of a desktop system is especially vulnerable to the far-field noise of an open-plan office environment.

Sophisticated telephones may incorporate various types of noise suppression. Most existing noise suppression approaches address stationary "background sound" (e.g., HVAC). Suppression of non-stationary "noise" (e.g., side conversations, music, door slam, street noise, keyboard typing, printers and copiers) is a much more challenging problem. Algorithms that address non-stationary noises are typically complicated, calculation intensive, and often result in distortion of the primary speech.

Systems and methods which enable control and reduction of both stationary and non-stationary noise with efficient audio signal processing and minimal equipment investment would significantly improve the audio experience of communications in open-plan office environments.

SUMMARY

Methods, systems, and devices for noise suppression in desktop telephone system-based communication are disclosed. In one embodiment, multiple reference microphones monitor far-field noise surrounding a primary desktop telephone within an open-plan office configuration. A main microphone in the primary desktop telephone receives a main audio signal including both the primary speaker's voice, when active, and far-field noise. By comparing the far-field noise measured by the reference microphones with the audio signal from the main microphone of the primary communication device, far-field noise in the main audio signal may be identified and suppressed in the audio signal transmitted to a receiving communication device.

In an embodiment, reference microphones are selected or arranged to define an acoustic perimeter with respect to the primary communication device. The acoustic perimeter defines the "far-field" with respect to a primary communication device. That is, noises identified by the reference microphones to be in the "far-field" or outside the acoustic perimeter may be suppressed in the audio signal transmitted by the primary communication device to a receiving communication device. Note that far-field noise may be any noise generated at a distance of at least 6 inches from the main microphone. By selecting and arranging reference microphones to be positioned between noise sources and the primary telephone, the reference microphones may form an acoustic perimeter around the primary telephone, enabling isolation of the speaker's voice from far-field noise.

For example, a reference microphone may be selected and positioned within the open-plan office configuration to preferentially detect background sound over the voice of the primary speaker using the primary telephone. For example, a reference microphone may be positioned with respect to the primary microphone so that the path from the primary speaker to the reference microphone is attenuated, while the audio path from a noise source to the reference microphone is similar to the audio path from the noise source to the main microphone. In addition, the reference microphone may be selected to have directionality so that it preferentially detects noises and sounds originating from either outside or inside the acoustic perimeter while being less likely to detect primary voice signal inside the acoustic perimeter, which can result in cleaner noise reduction.

Reference microphones may be contained within dedicated microphone devices or other communication devices. In one embodiment, reference microphone devices may be positioned above each cube containing a desktop telephone. In another embodiment, the reference microphone devices may be positioned along or above the partitions between workstations. Reference microphone devices may be placed in or around other sources of background noise, such as hallways, or near windows. In another embodiment, reference microphone devices are used in conjunction with acoustic barriers to create microphone directionality and isolate a reference microphone from primary sound sources.

In another embodiment, two or more desktop speakerphones form an array of microphones within an open-plan office configuration. One desktop speakerphone serves as a reference microphone, detecting far-field noise for another primary speakerphone. For example, microphones on each desktop speakerphone located on a desk or in a cube adjacent to a primary desktop telephone may each be designated as a reference microphone. Using existing microphones on existing desktop speakerphones as reference microphones allows identification of far-field noise without introducing additional sound detection equipment. Desktop speakerphones adjacent to a primary speakerphone may define an acoustic perimeter around the primary speakerphone, identifying far-field noise to be suppressed. Furthermore, noise suppression may be incorporated into an existing array of desktop communication devices through the use of software incorporated into each communication device or a separate audio signal processor incorporated into the communication array.

BRIEF DESCRIPTION OF THE DRAWINGS

Exemplary embodiments of the present invention will be more readily understood from reading the following description and by reference to the accompanying drawings, in which.

DETAILED DESCRIPTION

Methods, systems, and devices for reducing noise transmitted by a desktop communication device are disclosed. An open-plan office configuration leaves desktop telephone users exposed to a multitude of office noises including stationary background sound, for example HVAC, and non-stationary noises, such as neighboring conversations and office equipment. Such far-field background sound and noises can be transmitted as part of the speakerphone conversation, leading to poor communication and confidentiality concerns.

In one aspect of the invention, the amount of noise transmitted by a desktop phone in an open-plan office environment is reduced by defining an acoustic perimeter with respect to a primary communication device using reference microphones. Detection of sounds by the reference microphones outside the acoustic perimeter informs the transmission of the main audio signal from the primary communication device. The reference microphones may be used to generate a reference audio input including far-field noise (e.g. stationary background sound and non-stationary noise) in the proximity of a primary desktop telephone. The primary desktop telephone generates a main audio input including the voice of the primary speaker as well as background noise. The reference audio input is compared to main audio input from the primary speakerphone to identify the far-field noise portion of the main audio signal. A noise reduction algorithm suppresses the far-field noise in the main audio signal. The reference microphones defining the acoustic perimeter may be included within separate microphone devices placed in proximity to the main desktop phone, within other nearby desktop telephone devices, or within a combination of both types of devices.

In another aspect of the invention, the need for dedicated noise reduction equipment in an open-plan office configuration is reduced or eliminated by a collaborative network or array of desktop speakerphones. Microphones within desktop speakerphones in cubes or at work stations surrounding a primary speakerphone may be used to generate a reference audio signal containing far-field noise that may interfere with the primary speaker's voice over the primary speaker phone. As such, the surrounding desktop speakerphones may define an acoustic perimeter for a primary speakerphone without a need for installation of additional microphone devices.

Figure 1:
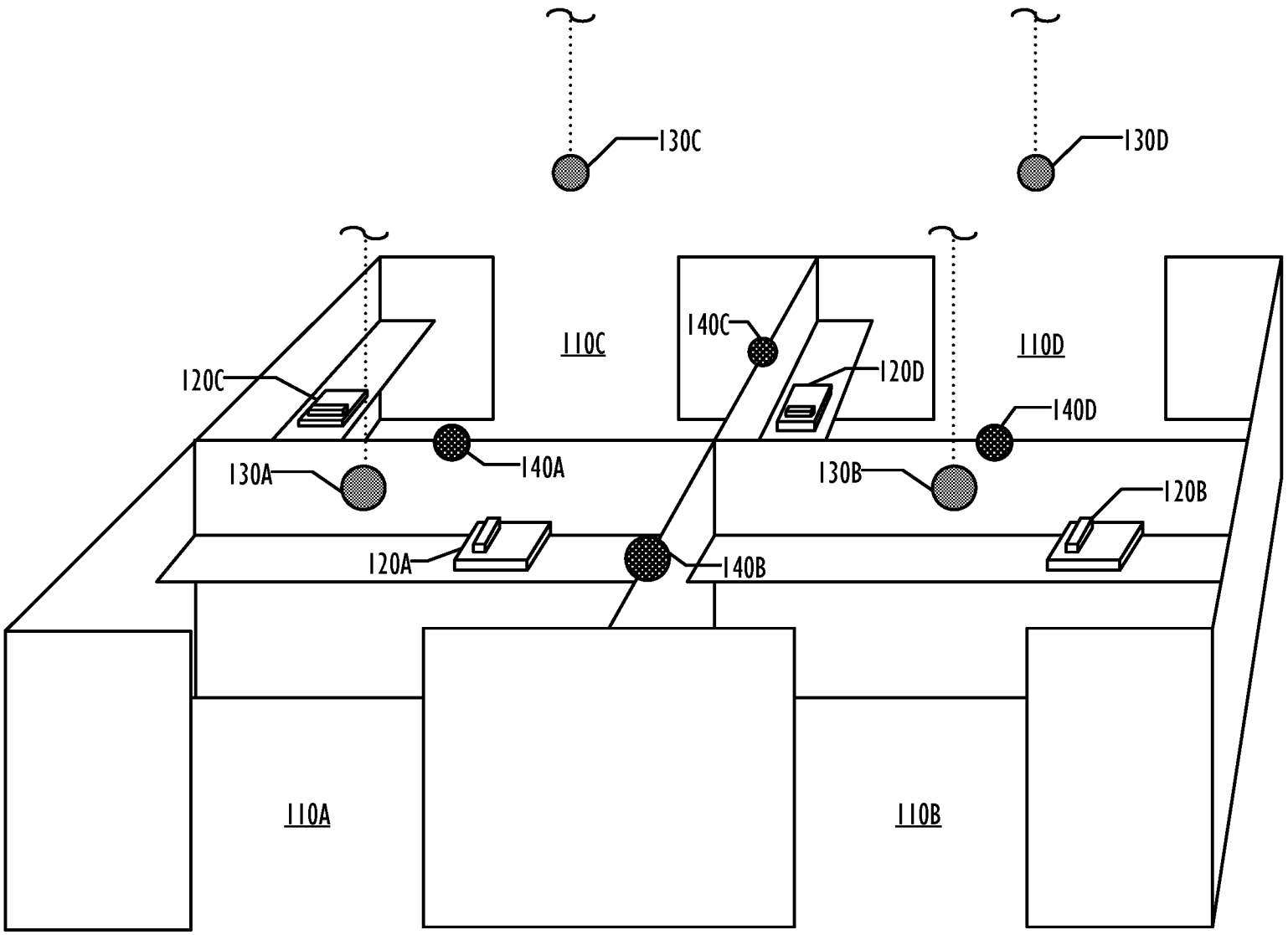
FIG. 1 illustrates a perspective view of a desktop communication system with noise suppression in an open-plan office according to an embodiment of the present invention.

FIG. 1 illustrates an open-plan office configuration including cubicles 110A-D having an array of desktop telephones 120-D and an array of microphone devices 130A-D and 140A-D, according to an embodiment of the invention. Examples of desktop telephones 120A-D can include products such as POLYCOM® SoundPoint IP® series, POLYCOM® VVX® series, etc. In an embodiment, telephone 120A is the primary speakerphone, and the microphone within speakerphone 120 into which a primary speaker speaks is the main microphone. When the primary speaker is engaged in voice communication via primary telephone 120A, the audio input from the main microphone includes the desired voice of the speakerphone user. In addition to the voice of the primary speaker, primary speakerphone 120A may be exposed to noise from a variety of sources due to the open-plan nature of the office. Noise sources may include stationary noises, such as from a heating, ventilation and cooling (HVAC) system, or non-stationary noises, such as voices and typing from neighboring cubes 110B-D, office equipment (e.g., printers), shutting doors, and street noise.

In one embodiment of the invention, a number of microphone devices 130A-D and 140A-D are positioned within the open-plan office to capture far-field noise. One or more of microphone devices 130A-D and 140A-D are designated as a reference microphone with respect to primary speakerphone 120A, according to an embodiment. Reference microphones are selected and positioned so that there is a direct auditory path from sources of far-field noise (e.g., in neighboring cubes) to the microphone device containing the reference microphone. At the same time, the auditory path from the primary speaker to a reference microphone is attenuated, as the primary speaker is at some distance from the microphone devices and is speaking directly into the main microphone of primary phone 120.

For example, partition microphone devices 140A and 140B may be designated reference microphones because they are positioned on the partition between the primary speakerphone 120A and neighboring cubicles 110C and 110B, respectively. Partition microphone devices 140A and 140B may generate a reference audio signal containing voices and typing from neighboring cubicles 110C and 110B. In addition, overhead microphones 130A-D are shown attached or suspended from the ceiling over cubicles 110A-D, according to an embodiment. In an embodiment, overhead microphone 130A is designated as the sole reference microphone with respect to primary telephone 120A. Overhead microphone device 130A is positioned to capture much of the far-field noise that may also be captured by the main microphone on primary telephone 120A. In another embodiment, overhead microphone devices 130A-D are designated as reference microphones with respect to primary telephone 120. The addition of overhead microphones 130B and 130C enable monitoring and suppression of far-field noise coming from adjacent cubes 110B and 110C, respectively. Though overhead microphones 130A-D are shown directly above cubicles 110A-D, overhead microphones 130A-D may be otherwise positioned, such as to capture HVAC or hallway noise. Reference audio signals detected by microphone devices 130A-D and 140A-D may be used to determine the background audio signal used by an algorithm to reduce far-field noise in a transmitted audio signal based on a comparison with the main audio signal.

In another embodiment, a microphone included in each of desktop telephones 120B-D is designated a reference microphone with respect to primary telephone 120. Each of desktop telephones 120B-D includes at least one microphone capable of detecting sound within and in the vicinity of its respective cube 110B-D. In an embodiment, telephones 120B and 120C are designated secondary desktop telephones. A main audio input is generated by desktop telephone 120A, including the voice of a speaker and far-field noise. Reference audio inputs are generated by each reference microphone on secondary speakerphones 120B-C. In this manner, far-field noise detected in neighboring cubes 110B-C can be included in a reference audio signal which will be used by an algorithm to isolate the voice portion of the main audio input from primary speakerphone 120A. By using microphones on other speakerphones in the open-office configuration, the far-field noise can be detected and suppressed without requiring additional microphone devices 130A-D and 140A-D.

In yet another embodiment, a combination of both microphone devices 130A-D and 140A-D and secondary speakerphones 120B-C may be designated as reference microphones. The one or more reference microphones, by detecting far-field noise which may be suppressed from a main audio signal, effectively form an acoustic perimeter around the primary speakerphone.

Figure 2:
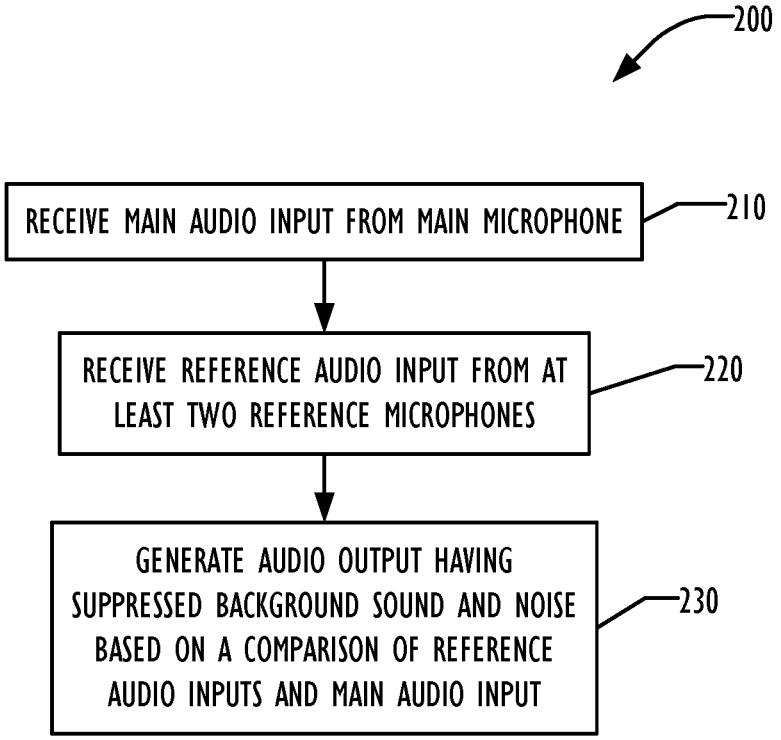
FIG. 2 is a flow chart illustrating a method for suppressing noise transmitted by a desktop communication system in an open-plan office environment according to an embodiment of the present invention.
Figure 3:
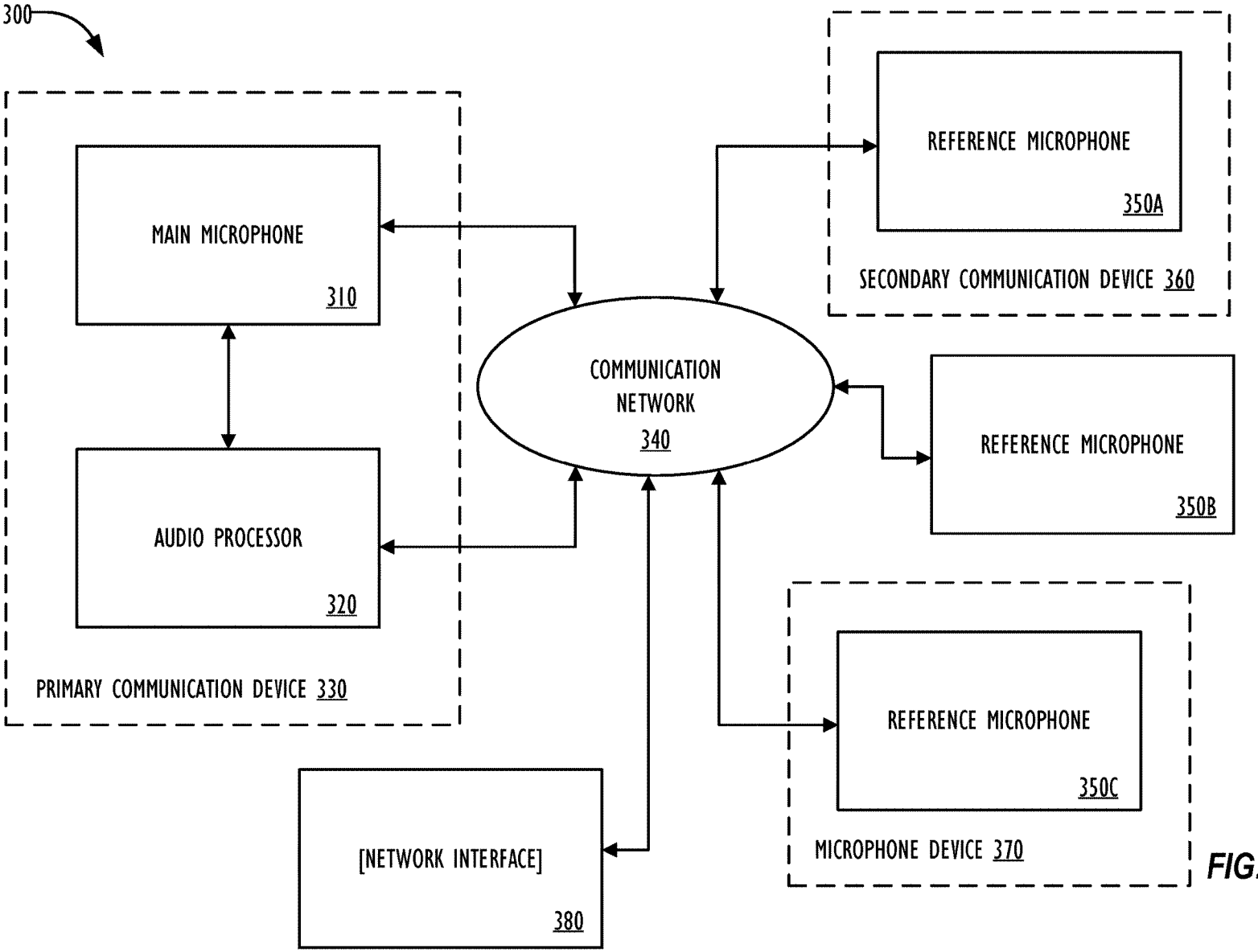
FIG. 3 shows a functional block diagram of a system for suppressing noise transmitted by a desktop communication device in an open-plan office environment according to an embodiment of the invention.
Figure 4:
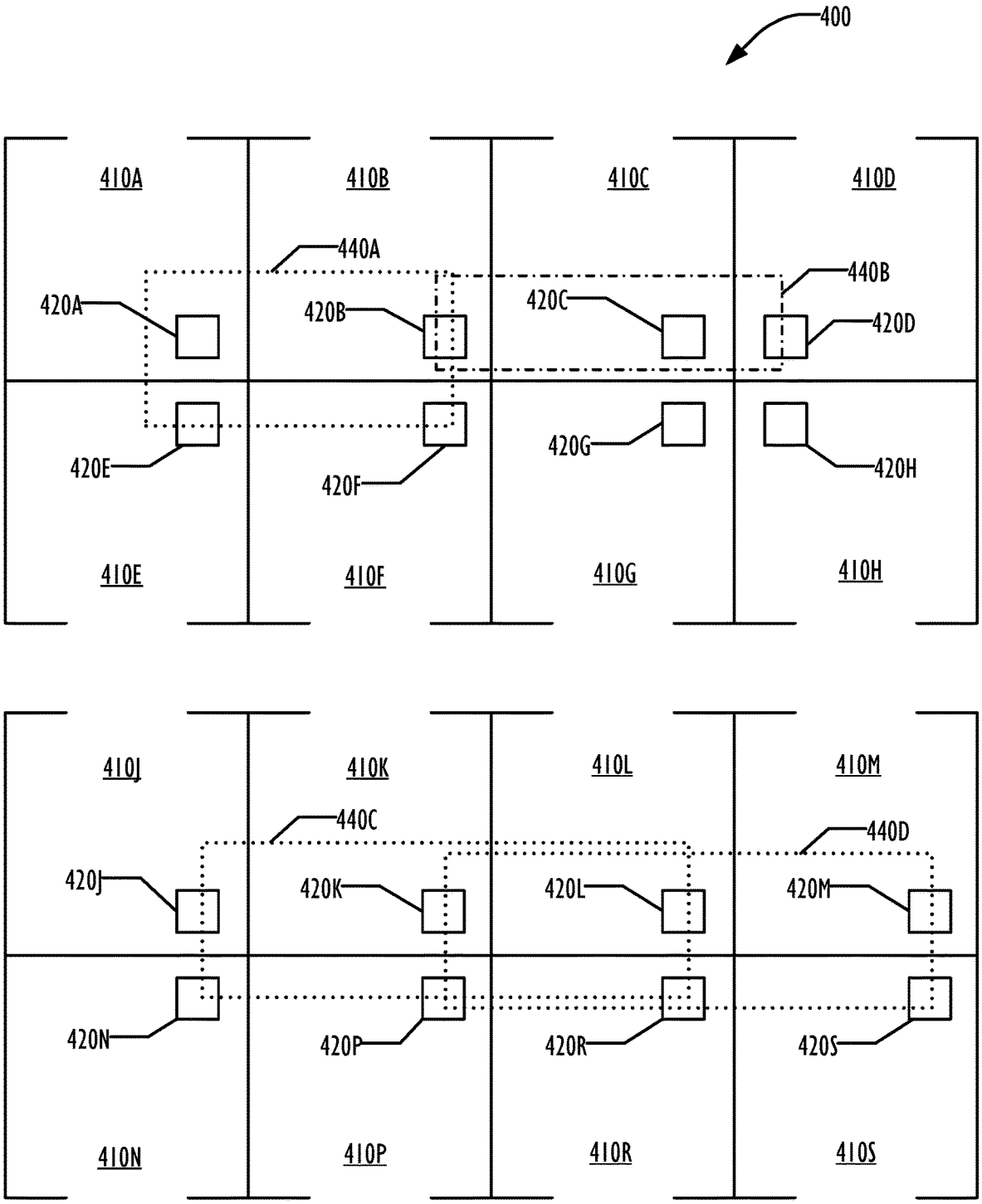
FIG. 4 illustrates a top-down view of an open-plan office environment including an array of desktop communication devices according to an embodiment of the present invention.
Figure 5:
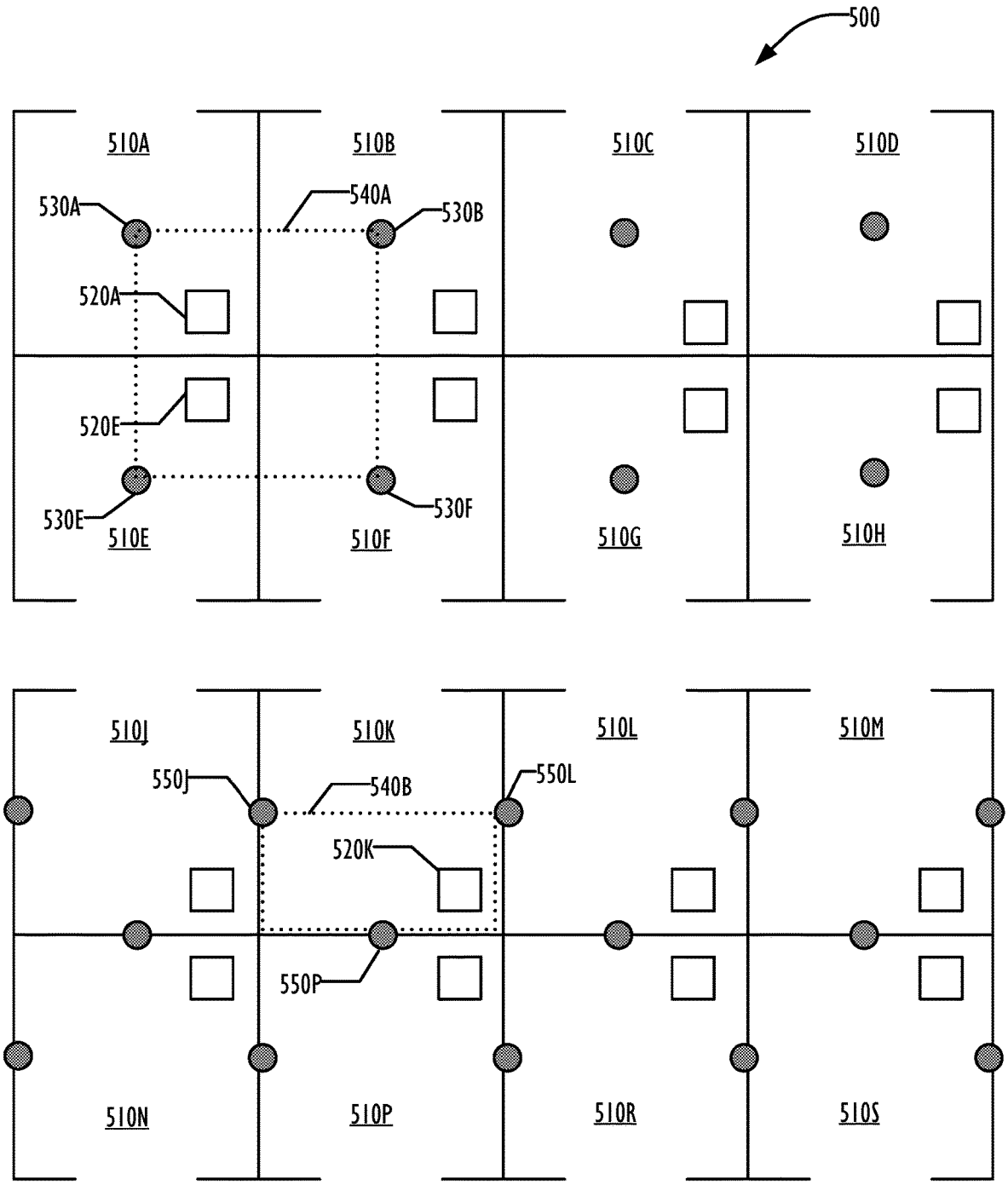
FIG. 5 illustrates a top-down view of an open-plan office environment including microphone devices defining an acoustic perimeter with respect to a desktop communication device according to an embodiment of the present invention.
Figure 8:
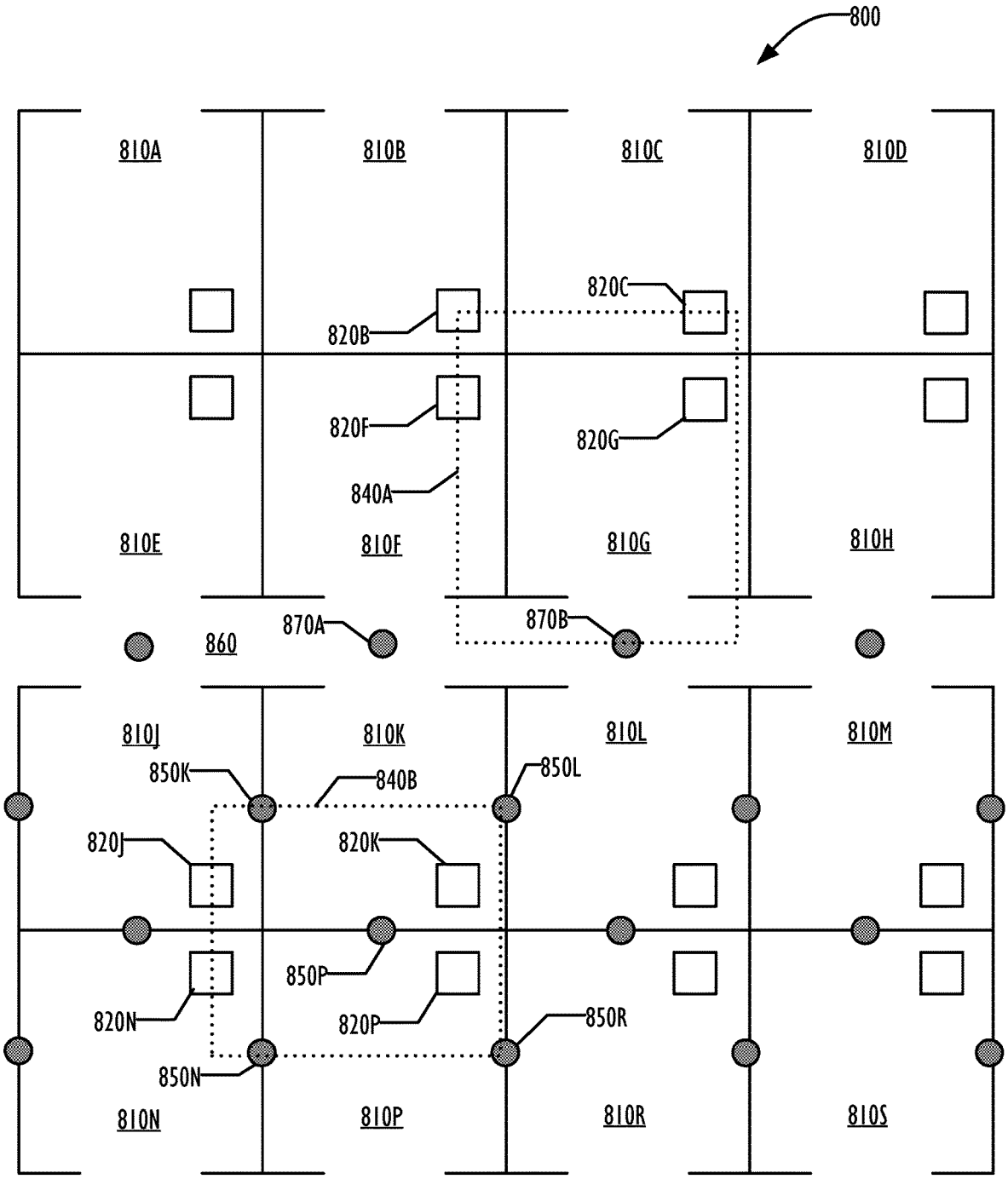
FIG. 8 illustrates a top-down view of an open-plan office environment including microphone devices and reference communication devices defining an acoustic perimeter with respect to a desktop communication device according to an embodiment of the present invention.

FIG. 2 is a flow chart illustrating a method 200 for reducing far-field noise transmitted by a desktop telephone in an open-plan office environment, according to an embodiment of the invention. Throughout the description of FIG. 2, reference will be made to elements of FIG. 3, illustrating a communication system 300 which reduces noise transmitted by a desktop speakerphone in an open-plan office environment, according to an embodiment of the invention. Reference will also be made to FIGS. 4, 5 and 8, each illustrating the arrangement of devices within an open-plan office environment, according to an embodiment of the invention.

The method 200 may be performed by an audio processor 320, which includes a processing component and a tangible storage device storing instructions executable on the processing component. In an embodiment, audio processor 320 executes a noise-suppression algorithm based on main audio signal and at least one reference audio signal which results in an audio signal having reduced far-field noise for transmission to a receiver of the communication.

In block 210, main audio input is received from a main microphone, according to an embodiment of the invention. A main microphone 310 receives a voice communication from a primary speaker, according to an embodiment. In an embodiment, main microphone 310 also picks up background sound and noise. Main microphone 310 generates a main audio signal including both the primary speaker's voice and the background noise. In an embodiment, main microphone 310 is part of a primary communication device 330. Primary communication device may be any microphone-based communication device, such as a desktop speakerphone, video system, conference system, mobile telephone, desktop computer system, laptop, or tablet.

In an embodiment, audio processor 320 and main microphone 310 are components of a single primary communication device 330, and the main audio input from main microphone 310 is communicated to audio processor 320 via means internal to primary communication device 330. In another embodiment, audio processor 320 is located on a separate device from main microphone 310, so that the main audio input is received via a communication network 340 communicatively linking the two devices. In this embodiment, the audio processor 320 may be located in an IP PBX or voice over internet protocol (VoIP) server to provide centralized operation. In an embodiment, communication network 340 is a local area network (LAN). Communication network 340 may be interfaced with an extra-office network, such as the Internet for VoIP, via a network interface 380.

In block 220, a reference audio input is received from one or more reference microphones, according to an embodiment of the invention. Communication system 300 includes one or more reference microphones 350A-C, according to an embodiment of the invention. Each of reference microphones 350A-C generates a reference audio signal containing sound and noise in its vicinity, according to an embodiment. In an embodiment, reference microphone 350A is a component of a communication device, designated a secondary communication device 360. The secondary communication device 360 may be any microphone-based communication device, such as a desktop speakerphone, video call system, conference system, mobile telephone, a desktop computer system, a laptop, or a tablet. In another embodiment, reference microphone 350C is included within a microphone device 370. Microphone device 370 is a device whose primary purpose is to generate an audio signal from one or more microphone components.

The one or more reference audio input signals from reference microphones 350A-C are communicated to audio processor 320 via a communication network 340, according to an embodiment of the invention. In another embodiment, the reference audio signal from one or more of reference microphones 350A-C is communicated directly to audio processor 320 (i.e. not via a communications network 340), for example, where a primary communication device 330 has a designated microphone device 370 to generate a reference audio signal specifically for primary communication device 330. In yet another embodiment, one or more reference audio signals is communicated to audio processor 320 via a communications network, while one or more reference audio signals communicated to audio processor 320 are not communicated via a communications network. For example, a primary communication device 330 may receive reference audio input signals directly from a designated microphone device 370 and also from a secondary communication device 360 via a communication network 340.

Reference microphones are selected and positioned in order to capture far-field noise that may also be captured by the main microphone. For example, reference microphones may be positioned between the primary communication device and identified sources of sound. In an embodiment, reference microphones are selected or arranged to define an acoustic perimeter with respect to the primary communication device. The acoustic perimeter defines the "far-field" with respect to a primary communication device. That is, noises identified by the reference microphones as originating from the "far-field"/outside the acoustic perimeter may be suppressed in the audio signal transmitted by the primary communication device to a receiving communication device. By selecting and arranging reference microphones to be positioned between noise sources and the primary telephone, the reference microphones may form an acoustic perimeter around the primary telephone, enabling isolation of the speaker's voice from far-field noise.

FIGS. 4, 5 and 8 illustrate the positioning of reference microphones with respect to a main microphone. FIG. 4 illustrates an open-plan office configuration where other desktop phones serve as the reference microphones for a primary desktop phone, according to an embodiment. FIG. 5 illustrates an open-plan office configuration where microphone devices serve as reference microphones for a primary desktop phone, according to an embodiment. FIG. 8 illustrates an open-plan office configuration where both desktop devices and microphone devices serve as reference microphones for a primary desktop phone, according to an embodiment.

An open-plan office configuration provides minimal noise shielding for speakerphone conversations. Though FIGS. 4-5 and 8 illustrate a cubicle embodiment of an open-plan office configuration, it is to be understood that open-plan office configurations encompass a variety of situations where a desktop speakerphone is exposed to noise during use. In an embodiment, an open-plan office configuration is any configuration where a speakerphone is used without adequate noise shielding from sounds and noise that may interfere with communication via the speakerphone. For example, adequate noise shielding may exist in an enclosed conference room with noise-insulating walls. In contrast, where a desktop speakerphone is not isolated within an enclosed room, external noise shielding may be inadequate. In another embodiment, an open-plan office configuration is where multiple desktop telephones are located in acoustic proximity to one another. For example, an open-plan office configuration may be where the acoustic ranges of two or more speakerphones overlap.

In FIG. 4, cube farm 400 includes a number of cubes 410, each including a communication device, according to an embodiment of the invention. Communication devices 420A-B and 420E-F are located in cubes 410A-B and 410E-F, respectively. Each communication device 420 includes at least one microphone for use in speaker-based communication. Communication devices 420 may each be, for example, a desktop speaker phone, video phone, conference system, desktop computer, mobile phone, laptop, or tablet computer. Communication device 420A is designated a primary communication device, according to an embodiment. Primary communication device 420A includes the main microphone that generates the main audio input including a speaker/user's voice along with background sound and noise.

In an embodiment, each of communication devices 420B and 420E-F is designated as a secondary communication device. Each of secondary communication devices 420B and 420E-F includes a reference microphone that generates a reference audio input. Secondary communication devices 420B and 420E-F are located in secondary cubes 410B and 410E-F adjacent to primary cube 410A. As such, secondary communication devices 420B and 420E-F, by nature of being the desktop speakerphones located in cubes 410B and 410E-F, are positioned to capture sounds within their respective cubes that, if detected by the main microphone in primary communication device 420A, would constitute far-field noise with respect to the voice of the speaker/user in primary cube 410A. By recording background sounds and noise in the cubes 410B and 410E-F surrounding primary communication device 420A, secondary communication devices 420B and 420E-F form an acoustic perimeter 440A around primary device 420A. In an embodiment, acoustic perimeter 440 defines the far-field region with respect to primary communication device 420A, outside of which background sounds and noises are detected and may be suppressed. The precise delineations of acoustic perimeter 440A depend on the acoustic range and properties of each of the reference microphones in secondary communication devices 420B and 420E-F. For example, though acoustic perimeter 440A is illustrated as a box surrounding primary communication device 420A, the specific polarity of the reference microphones, the range and sensitivity of the microphones, as well as the position and orientation of the secondary communication devices 420B and 420E-F may all affect the precise delineations of acoustic perimeter 440A. In addition, other configurations are possible—for example, the communication devices 410A-D may be differently positioned within their respective cubes 420A-D, which may alter the delineation of the acoustic perimeter 440.

Though three secondary communication devices 420B and 420E-F are illustrated as defining acoustic perimeter 440A, more or fewer secondary communication devices may be used. In one embodiment, two secondary communication devices 420B and 420D define an acoustic perimeter 440B with respect to primary communication device 410C. In an embodiment, the spatial geometry of reference microphones 420B and 420D with respect to 420C allow for identification of far-field noises originating from the direction of cube 410G, though device 420G is not used as a reference device. In another embodiment, five communication devices 420J, 420L, 420N, 420P and 420R are designated as secondary communication devices defining acoustic perimeter 440C with respect to primary communication device 420K. In yet another embodiment, for a given primary communication device, every other communication device in the cube farm is designated as a secondary communication device.

Furthermore, an individual communication device may serve as both a primary communication device and as a secondary communication device with respect to another primary communication device. A communication device may fulfill primary and secondary roles either simultaneously or at different times. For example, communication device 420L is shown as a secondary communication device defining acoustic perimeter 440C with respect to primary communication device 420K, according to one embodiment. However, communication device 420L may also be a primary communication device. Communication device 420K is illustrated as a secondary communication device defining acoustic perimeter 440D with respect to primary communication device 420L, according to another embodiment. In order to fulfill primary and secondary roles, communication device 420L may have a single microphone generating a single audio signal that serves as the main audio input for communication device 420L and also as a reference audio input for other communication devices, such as communication device 420K. In another embodiment, communication device 420K includes more than one microphone, including a main microphone for generating a main audio input while serving in the communication device's primary capacity, and also including at least one other microphone designated as a reference microphone for generating a reference audio input with respect to any other number of primary communication devices in the communication device array.

While acoustic perimeters 440A-D are illustrated as quadrangles defined by straight lines, it will be understood to one of ordinary skill in the art that the shape of an acoustic perimeter will depend on a wide variety of factors, such as placement of reference devices, orientation of the reference devices, intervening barriers (intentional or otherwise), microphone directionality, etc. In addition, the though in the top-down view the acoustic perimeters 440A-D are illustrated as two dimensional, they are, in fact three-dimensional surfaces, including an overhead component.

Referring to FIG. 5, open-plan office configuration 500 comprises a number of cubes 510, according to an embodiment of the invention. In an embodiment, a communication device 520 is located in each cube 510. Open-plan office configuration 500 includes a number of reference microphone devices 530 and 550, according to an embodiment. Reference microphone devices 530 are overhead reference microphone devices located above a cube or workstation 510, according to an embodiment. Reference microphone devices 550 are partition-based reference microphone devices located between adjacent cubes or workstations 510, according to an embodiment.

In an embodiment, a microphone in each of reference microphone devices 530A-B and 530E-F is designated as a reference microphone with respect to a primary communication device 520A in cube 510A. Reference microphone devices 530A-B and 530E-F form an acoustic perimeter 540A around primary communication device 520A, according to an embodiment. Primary communication device 520A includes a main microphone, which records the voice of a user of primary communication device 520A within cube 510A along with surrounding office background sound and noise.

Overhead reference microphone devices 530A-B and 530E-F may each be mounted on the ceiling above a cube or workstation, or suspended in some other fashion so as to be located above or within the underlying cube. In an embodiment, the placement of reference microphone device 530A above cubicle 510A allows detection of far-field noise with respect to primary device 520A, but keeps reference microphone device 530A at a sufficient distance from the speaker/user and primary device 520A that microphone device 530A will not strongly pick up the voice of the speaker. In an embodiment, microphone devices 530B and 530E-F capture background sound and noise within adjacent cubicles, which, due to their proximity, is likely to be detected by the main microphone in primary device 520A. That is, in an embodiment, the audio path from a source of background sound or noise to each of reference microphone devices 530A-B and 530E-F is similar to the audio path from the background sound or noise to the main microphone in primary desktop telephone 520A. However, because a primary speaker speaks directly into the main microphone of primary communication device 520A, the audio path from the primary speaker to the main microphone is direct, while the audio path from the primary speaker to the reference microphones of the microphone devices 530A-B and 530E-F is attenuated. The difference between the main audio signal and the reference audio signals enables isolation of the primary speaker's voice, and suppression of far-field noise. It is to be understood that, depending on the desired level of noise suppression and the particular audio characteristics of the microphones involved, any single microphone device 530A-B and 530E-F or combination of microphone devices 530A-B and 530E-F may be designated as a reference microphone with respect to primary desktop telephone 520A.

Perimeter reference microphone devices 550J, 55L, and 550P, located between cube 510K and cubes 510J, 510L, and 510P, respectively, form an acoustic perimeter 540B around primary communication device 520K in cube 510K, according to an embodiment. Reference microphone devices 550J, 55L, and 550P are located on or above the cube partitions separating cube 510K from neighboring cubes 510J, 510L, and 510P. As such, microphone devices 550J, 55L, and 550P are positioned to detect far-field noise in the adjacent cubes which is likely to be picked up by the main microphone of primary communication device 520K. In an embodiment, microphone devices 550J, 55L, and 550P are each designated as a reference microphone with respect to primary communication device 520K. By detecting far-field noise surrounding primary communication device 520K, microphone devices 550J, 55L, and 550P may define an acoustic perimeter 540B.

Figure 6A:
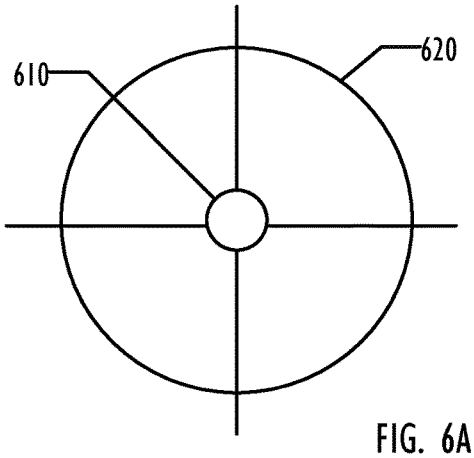
FIGS. 6A-6C illustrate example polarities of microphones for use in forming an acoustic perimeter according to an embodiment of the present invention.
Figure 6B:
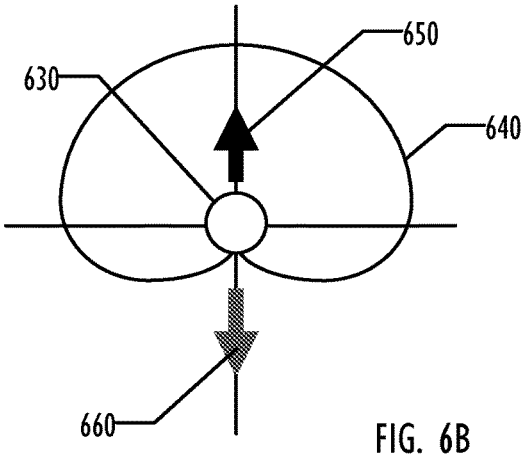
Figure 6C:
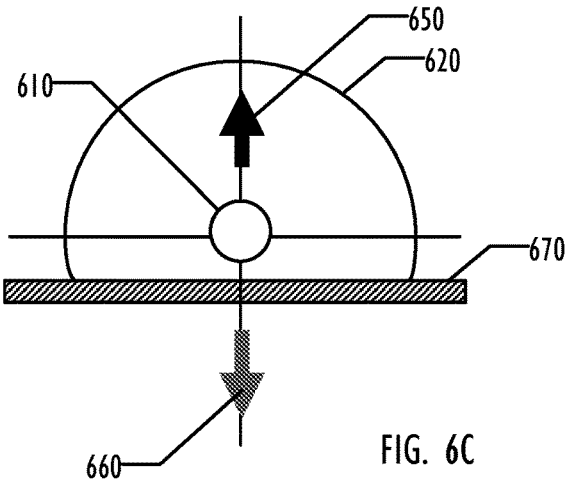

In addition to selecting the placement of reference microphone devices 530 and 550 in order to define an appropriate acoustic perimeter, reference microphones may be selected to have a particular polarity. For example, overhead reference microphones 530 may have omnidirectional polarity or directional polarity. FIGS. 6A-6C illustrate microphones having varying directionality, according to embodiments of the invention. FIG. 6A illustrates a cross-sectional view of the pattern of an omnidirectional microphone 610, according to an embodiment. An omnidirectional microphone as a uniform radial range, that is, it senses sound equally in all directions. Though shown as circular in cross-section, the shape of the pattern 620 is roughly spherical in three dimensions.

FIG. 6B illustrates a cross-sectional view of the pattern of a directional microphone 630 having a cardioid microphone polarity pattern 640, according to an embodiment. As understood in the art, cardioid microphones are considered to be "unidirectional," in that they have significantly greater sensitivity to sound from a primary direction, indicated by arrow 650, as compared to sound from a null direction, indicated by arrow 660.

FIG. 6C illustrates an omnidirectional microphone 610 having a spherical pattern 620 used in conjunction with an acoustic barrier 670, according to an embodiment. Acoustic barrier 670 insulates the microphone 610 from sound on the opposing side of the barrier. The use of an acoustic barrier allows an omnidirectional microphone 610 to function as a directional microphone, as it has significantly greater sensitivity to sound from a primary direction 650 as compared to a null direction 660. An acoustic barrier may be placed at any point between a sound source and the microphone in order to prevent the sound source from being detected by the microphone. For example, an acoustic barrier may be used between an overhead reference microphone device and a primary communication device in order to reduce the amount of voice signal detected by the overhead reference microphone.

Figure 7A:
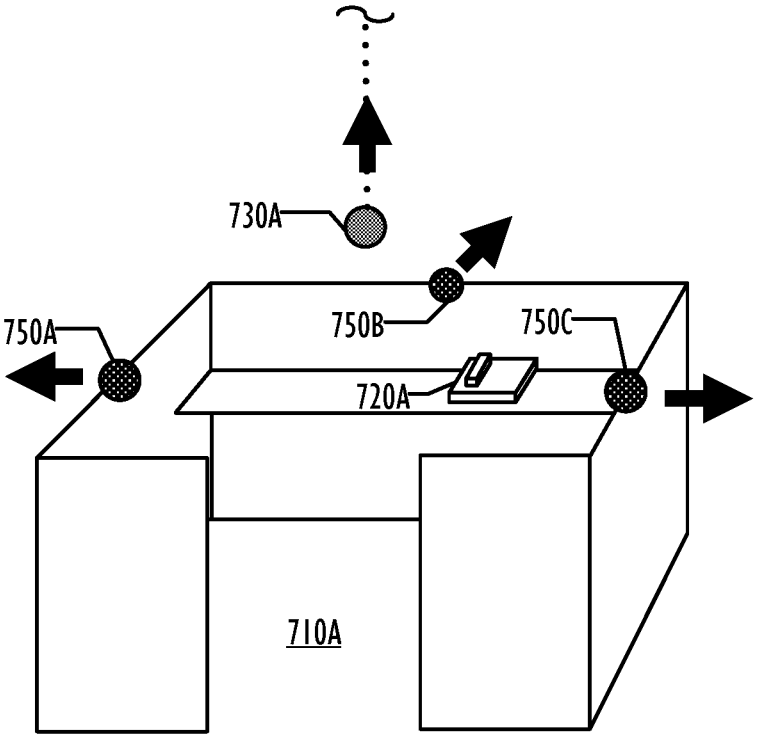
FIG. 7A illustrates a perspective view of directional microphones defining an acoustic perimeter with respect to a desktop communication device according to an embodiment of the present invention.
Figure 7B:
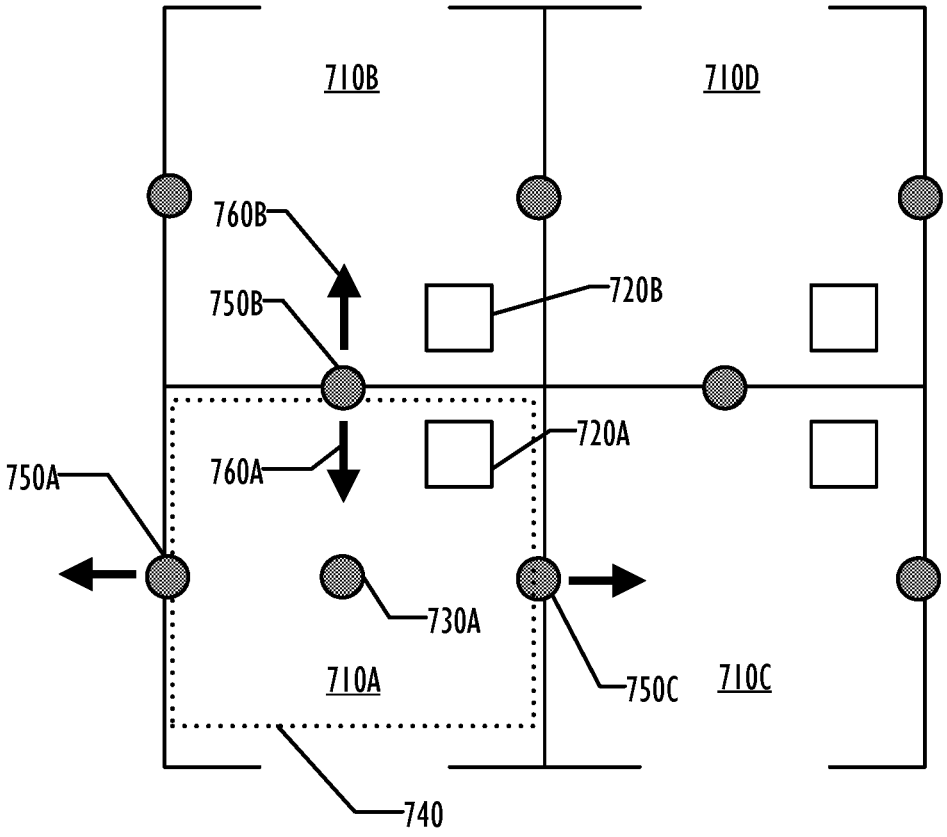
FIG. 7B illustrates a top-down view of directional microphones defining an acoustic perimeter with respect to a desktop communication device according to an embodiment of the present invention.

FIGS. 7A-B illustrate how directional reference microphones may be used to define an acoustic perimeter with respect to the main microphone of a primary communication device, according to an embodiment of the invention. FIG. 7A illustrates a perspective view of a cube 710A including a primary communication device 720A, according to an embodiment. FIG. 7B illustrates a top-down view of cube 710A and adjacent cubes 710B-C, according to an embodiment. Reference microphone devices 750A-C are each located on the partition walls of cube 710A, according to an embodiment. Reference microphone devices 750B and 750C are located between cube 710A and adjacent cubes 710B and 710C, respectively. Overhead reference microphone device 730A is suspended from the ceiling above cube 710A, according to an embodiment. Together, partition reference devices 750A-C and overhead reference device 730A define acoustic perimeter 740.

In an embodiment, each of reference microphone devices 750A-C contains a directional reference microphone. In an embodiment, each directional reference microphone is directed away from cube 710A in order to detect far-field noise outside of cube 710A. In addition, overhead reference microphone device 730A includes a directional reference microphone, directed upward and away from cube 710A. This may help capture far-field noise originating from sources above cube 710A, such as HVAC sounds. Directional microphones may be directed inside of the acoustic perimeter, or directed both inside and outside of the acoustic perimeter, in order to identify the location or proximity of a noise source with respect to the main microphone.

The use of directional microphones may enable definition of an acoustic perimeter 740 that is roughly aligned with the placement of the reference microphone devices 750A-C and 730A. However, it is to be understood that directional microphones are not required for the creation of an acoustic perimeter with respect to a primary communication device. Furthermore, as discussed above, while the acoustic perimeter 740 is shown in FIG. 7B as a two-dimensional line, it may in some cases be visualized as a surface enclosing cube 710A. Reference microphone devices 750A-C and 730A may include any suitable directional microphone, for example, those discussed above with respect to FIGS. 6B-C.

In an embodiment, perimeter reference microphone device 750B contains at least two directional microphones oriented in opposing directions 760A and 760B. This may enable the device to provide a separate reference audio input to each of the primary communication devices in adjacent cubes. For example, in reference microphone device 750B, the first directional reference microphone may be oriented in direction 720B toward cube 710B, generating a reference audio input for primary communication device 720A. The second direction reference microphone in reference microphone device 750B may be oriented in direction 720A toward cube 710A, generating a reference audio input for primary communication device 720B. In another embodiment, separate reference microphone devices incorporating directional microphones may be used for each primary communication device.

FIG. 8 illustrates acoustic perimeters 840A and 840B, each incorporating reference microphones contained within communication devices 820 and reference microphone devices 850 and 870, according to an embodiment of the invention. Open-plan office environment 800 includes a plurality of cubes or workstations 810. Each cube 810 includes a communication device 820, according to an embodiment. A combination of microphone device 870B and secondary communication devices 820B, 820C, and 820F form an acoustic perimeter 840A around a third primary communication device 820G in cube 810G. Microphone devices 870A-B are located in hallway 860 in order to capture hallway noise such as voices, footsteps, carts, printers, etc. The secondary communication devices 820B, 820C, and 820F capture sounds and noises in their respective cubes which may be detected by primary communication device 820G.

In another embodiment, reference devices are included within the acoustic perimeter, enabling detection of sounds and noise outside of the acoustic perimeter and within the acoustic perimeter. Noise detected outside the acoustic perimeter may be treated differently from noise within the acoustic perimeter. For example, a mute-based local talk detection method may be used with respect to far-field noises from outside the acoustic perimeter. In this case, when no voice component is identified in the main audio signal as compared to reference microphones directed outside of the acoustic perimeter, then the main microphone is muted. Conversely, for noise detected by reference microphones inside the acoustic perimeter, an estimate of the far-field noise may be subtracted from the main audio signal in order to suppress noise. It is to be understood that other appropriate noise suppression methods may be used with respect to noise detected inside the acoustic perimeter and outside the acoustic perimeter.

Referring to FIG. 8, partition reference microphone devices 850K, 850L, 850N, and 850R, along with secondary communication devices 820J and 820N, define acoustic perimeter 840B with respect to primary communication device 820K. Each of partition reference microphone devices 850K, 850L, 850N, and 850R and secondary communication devices 820J and 820N include reference microphones that generate a reference audio input signal, according to an embodiment. Reference microphone devices 850K, 850L, 850N, 850R, 820J and 820N may be directional or omnidirectional. In one embodiment, partition reference microphone device 850P, within the acoustic perimeter 840B, additionally generates a reference audio signal with respect to primary communication device 820K. By comparing the reference audio signal outside the acoustic perimeter with that of the reference audio signal from inside the acoustic perimeter, noise detected outside of the acoustic perimeter may be suppressed using a different method from the noise suppression method used to suppress noise detected inside the acoustic perimeter.

In block 230, audio output having suppressed far-field noise is generated based on a comparison of the reference audio input and the main audio input, according to an embodiment of the invention. As discussed above, the main audio input may include far field noise (stationary background sound and non-stationary noise) and the voice of the primary speaker/user. The reference audio input includes far-field noise. As such, by comparing the main audio input to the reference audio input, the far-field noise portion of the main audio input can be identified. The far-field noise portion of the main audio input may then be suppressed, resulting in an output audio signal having reduced background sound and far-field noise. Exemplary methods for suppressing far-field noise by comparing a main audio signal and a reference audio signal are described in U.S. Patent Publication 2014/0148224 entitled "Far Field Noise Suppression for Telephony Devices," which is incorporated herein by reference for all that it discloses.

Figure 9:
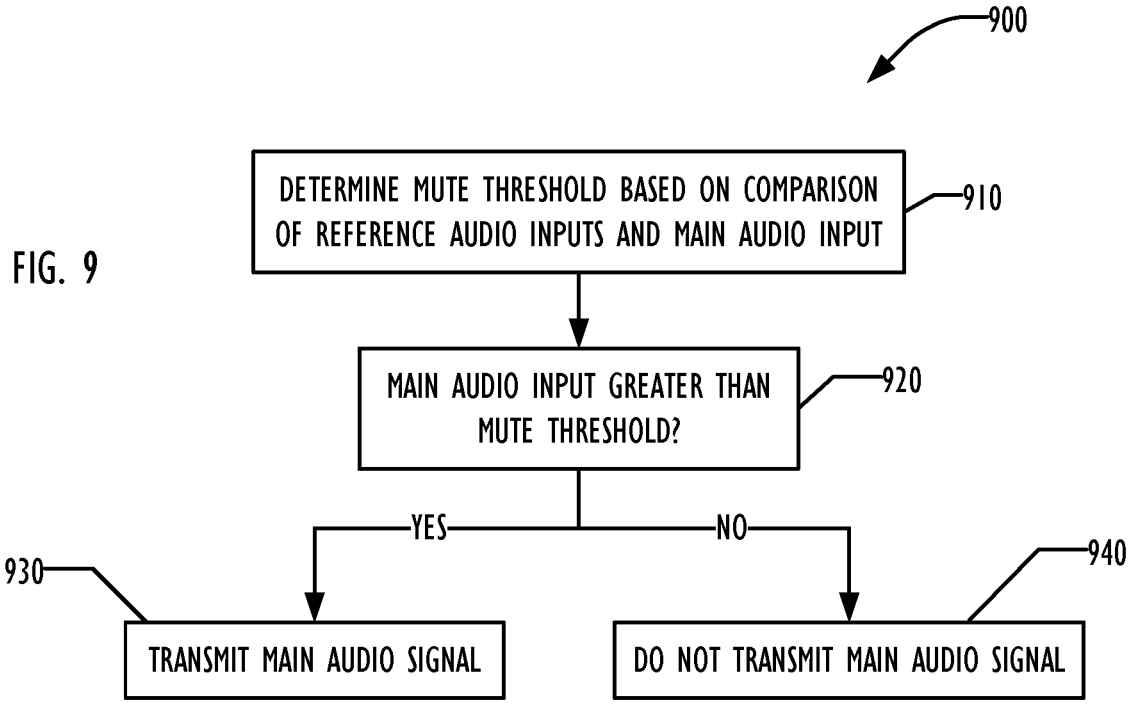
FIG. 9 is a flowchart illustrating a method for suppressing noise based on a reference audio input and a main audio input, according to an embodiment of the invention.

FIG. 9 illustrates a method 900 for suppressing far-field noise in an audio signal, according to an embodiment of the invention. In block 910, a mute threshold is determined, according to an embodiment of the invention. The mute threshold may be determined from an analysis and comparison of multiple reference audio inputs with the main audio input. In one embodiment, a primary reference audio input is identified. The primary reference audio input may be identified, for example, by selecting from the multiple reference audio inputs the reference audio input having the largest amount of energy. In one embodiment the energy is determined every 20 ms for the frequency range 300 Hz to 5000 Hz. The reference microphone with the largest energy can then be chosen for comparison to the primary microphone in some embodiments.

The primary reference audio input and main audio input are then each broken down into a number of subbands, according to an embodiment of the invention. A sum $D_2$ may be computed according to Equation 1:

$$D_2 = \sum_{i=o}^{P-1} \frac{X_{main}[i]}{X_{ref}[i]ERL[i]} \tag{1}$$

where Xmain[i] is the ith subband energy of the main audio input signal, Xref[i] is the ith subband energy of the reference audio input signal, and ERL[i] is the ith subband acoustic coupling between the main audio input and reference audio input, defined as the expectation of the ratio Xmain[i]/Xref[i] when there is no active local speech component to the main audio signal. The number "P" is the number of subbands in computing the sum $D_2$.

In an embodiment, acoustic coupling ERL[i] between the main audio input signal and reference audio input signal is about unity across the audio spectrum, so that $D_2$ is the sum of the ratio for all subbands. In an embodiment, the spectrum energy of the main audio input signal is 6 to 10 dB larger across the audio spectrum as compared to the reference audio input signal. As such, a mute threshold may be defined by Equation 2:

$$10*\log 10(D_2)>P*10 \text{ dB}. \tag{2}$$

In block 920, it is determined if the main audio input is greater than the mute threshold, according to an embodiment of the invention. In block 930, if the threshold is exceeded, then the main audio signal includes a primary speaker's voice, and is therefore transmitted as an audio output signal. In block 940, if the threshold is not exceeded, then the main audio signal contains only far-field noise, and so it is not transmitted. As such, far-field noise is suppressed in portions of the main audio output.

It is to be understood that the method in FIG. 9 is illustrative of one embodiment of a method for suppressing far-field noise in an output audio signal. A number of algorithms can accomplish the generation of audio output having suppressed far-field noise.

The above description is illustrative and not restrictive. Many variations of the invention will become apparent to those skilled in the art upon review of this disclosure. The scope of the invention should therefore be determined not with reference to the above description, but instead with reference to the appended claims along with their full scope of equivalents.

What is claimed is:

1. A primary communication device for use in an environment, the environment including:

a first primary communication device configured to transmit a first speaker's voice from the first primary communication device to a first receiving communication device, wherein the first primary communication device includes a first main microphone;

a second primary communication device configured to transmit a second speaker's voice from the second primary communication device to a second receiving communication device, wherein the second primary communication device includes a second main microphone;

a plurality of reference microphones, with each reference microphone in a different device, a first subset of the plurality of reference microphones forming a first perimeter about the first primary communication device and a second subset of the plurality of reference microphones forming a second perimeter about the second primary communication device;

a first processor configured to:

receive a first main audio input from the first main microphone;

receive first subset reference audio inputs from each of the reference microphones in the first subset, wherein the first subset reference audio inputs include far field noise with respect to the first primary communication device;

generate a first reduced-noise audio output having suppressed far field noise based on a comparison of at least one of the first subset reference audio inputs and the first main audio input; and provide the first reduced-noise audio output for transmission to the first receiving communication device; and a second processor configured to:

receive a second main audio input from the second main microphone;

receive second subset reference audio inputs from each of the reference microphones in the second subset, wherein the second subset reference audio inputs include far field noise with respect to the second primary communication device;

generate a second reduced-noise audio output having suppressed far field noise based on a comparison of at least one of the second subset reference audio inputs and the second main audio input; and provide the second reduced-noise audio output for transmission to the first receiving communication device, the primary communication device comprising:

a microphone; and a processor coupled to the microphone, wherein the primary communication device acts as both the first primary communication device and one of the second subset of the plurality of reference microphones, wherein the microphone of the primary communication device acts as the first main microphone of the first primary communication device and acts as one of the second subset of the plurality of reference microphones, and wherein the processor of the primary communication device acts as the first processor and is further configured to provide an audio output of the microphone as a reference audio input to the second processor.

2. The primary communication device of claim 1, wherein the primary communication device acts as the first primary communication device at one time and acts as the one of the second subset of the plurality of reference microphones at another time.

3. The primary communication device of claim 1, wherein the primary communication device acts as the first primary communication device and acts as the one of the second subset of the plurality of reference microphones at the same time.

4. The primary communication device of claim 1, wherein the processor is further configured to mute the main microphone when the comparison of the reference audio inputs to the main audio input indicates that the main audio input does not include a speaker's voice.

5. The primary communication device of claim 1, wherein the processor is further configured to subtract an estimate of the far-field noise from the main audio signal, wherein the estimate of the far-field noise is determined based on the comparison of the main audio input to at least one reference audio input.

6. The primary communication device of claim 1, wherein the processor is further configured to subtract an estimate of the far-field noise from the main audio signal, wherein the estimate of the far-field noise is determined based on the comparison of the main audio input to at least one reference audio input received from reference microphones within the acoustic perimeter.

7. The primary communication device of claim 1, wherein the processor is further configured to select, from the plurality of reference audio inputs, the reference audio input having the highest energy for comparison to the main audio input.

8. The primary communication device of claim 1, wherein the primary communication device is a speakerphone, and wherein the plurality of reference microphones are some combination of speakerphones, overhead microphones and cubicle wall microphones.

9. A method for audio processing in an environment, the environment including:

a first primary communication device configured to transmit a first speaker's voice from the first primary communication device to a first receiving communication device, wherein the first primary communication device includes a first main microphone;

a second primary communication device configured to transmit a second speaker's voice from the second primary communication device to a second receiving communication device, wherein the second primary communication device includes a second main microphone;

a plurality of reference microphones, with each reference microphone in a different device, a first subset of the plurality of reference microphones forming a first perimeter about the first primary communication device and a second subset of the plurality of reference microphones forming a second perimeter about the second primary communication device;

a first processor configured to:

receive a first main audio input from the first main microphone;

receive first subset reference audio inputs from each of the reference microphones in the first subset, wherein the first subset reference audio inputs include far field noise with respect to the first primary communication device;

generate a first reduced-noise audio output having suppressed far field noise based on a comparison of at least one of the first subset reference audio inputs and the first main audio input; and provide the first reduced-noise audio output for transmission to the first receiving communication device; and a second processor configured to:

receive a second main audio input from the second main microphone;

receive second subset reference audio inputs from each of the reference microphones in the second subset, wherein the second subset reference audio inputs include far field noise with respect to the second primary communication device;

generate a second reduced-noise audio output having suppressed far field noise based on a comparison of at least one of the second subset reference audio inputs and the second main audio input; and provide the second reduced-noise audio output for transmission to the first receiving communication device, the method comprising:

operating a primary communication device having a microphone and a processor coupled to the microphone to act as both the first primary communication device and one of the second subset of the plurality of reference microphones, wherein the microphone of the primary communication device acts as the first main microphone of the first primary communication device and acts as one of the second subset of the plurality of reference microphones, and wherein the processor of the primary communication device acts as the first processor and is further configured to provide an audio output of the microphone as a reference audio input to the second processor.

10. The method of claim 9, wherein the primary communication device acts as the first primary communication device at one time and acts as the one of the second subset of the plurality of reference microphones at another time.

11. The method of claim 9, wherein the primary communication device acts as the first primary communication device and acts as the one of the second subset of the plurality of reference microphones at the same time.

12. The method of claim 9, wherein generating a reduced-noise audio output comprises:

muting the main microphone when the comparison of the reference audio inputs to the main audio input indicates that the main audio input does not include a speaker's voice.

13. The method of claim 9, wherein generating a reduced-noise audio output comprises:

subtracting an estimate of the far-field noise from the main audio signal, wherein the estimate of the far-field noise is determined based on the comparison of the main audio input to at least one reference audio input.

14. The method of claim 9, further comprising:

selecting, from the plurality of reference audio inputs, the reference audio input having the highest energy for comparison to the main audio input.

15. A non-transitory storage medium storing programs for execution by a processor that cause the processor to perform the following method when executed on the processor, the processor included in a primary communication device for use in an environment, the environment including:

a first primary communication device configured to transmit a first speaker's voice from the first primary communication device to a first receiving communication device, wherein the first primary communication device includes a first main microphone;

a second primary communication device configured to transmit a second speaker's voice from the second primary communication device to a second receiving communication device, wherein the second primary communication device includes a second main microphone;

a plurality of reference microphones, with each reference microphone in a different device, a first subset of the plurality of reference microphones forming a first perimeter about the first primary communication device and a second subset of the plurality of reference microphones forming a second perimeter about the second primary communication device;

a first processor configured to:

receive a first main audio input from the first main microphone;

receive first subset reference audio inputs from each of the reference microphones in the first subset, wherein the first subset reference audio inputs include far field noise with respect to the first primary communication device;

generate a first reduced-noise audio output having suppressed far field noise based on a comparison of at least one of the first subset reference audio inputs and the first main audio input; and provide the first reduced-noise audio output for transmission to the first receiving communication device; and a second processor configured to:

receive a second main audio input from the second main microphone;

receive second subset reference audio inputs from each of the reference microphones in the second subset, wherein the second subset reference audio inputs include far field noise with respect to the second primary communication device;

generate a second reduced-noise audio output having suppressed far field noise based on a comparison of at least one of the second subset reference audio inputs and the second main audio input; and provide the second reduced-noise audio output for transmission to the first receiving communication device, the method comprising:

operating a primary communication device having a microphone, a processor coupled to the microphone and a non-transitory storage medium storing programs coupled to the processor to act as both the first primary communication device and one of the second subset of the plurality of reference microphones, wherein the microphone of the primary communication device acts as the first main microphone of the first primary communication device and acts as one of the second subset of the plurality of reference microphones, and wherein the processor of the primary communication device acts as the first processor and is further configured to provide an audio output of the microphone as a reference audio input to the second processor.

16. The non-transitory storage medium of claim 15, wherein the primary communication device acts as the first primary communication device at one time and acts as the one of the second subset of the plurality of reference microphones at another time.

17. The non-transitory storage medium of claim 15, wherein the primary communication device acts as the first primary communication device and acts as the one of the second subset of the plurality of reference microphones at the same time.

18. The non-transitory storage medium of claim 15, wherein generating a reduced-noise audio output comprises:

muting the main microphone when the comparison of the reference audio inputs to the main audio input indicates that the main audio input does not include a speaker's voice.

19. The non-transitory storage medium of claim 15 , wherein generating a reduced-noise audio output comprises:

subtracting an estimate of the far-field noise from the main audio signal, wherein the estimate of the far-field noise is determined based on the comparison of the main audio input to at least one reference audio input.

20. The non-transitory storage medium of claim 15, further comprising:

selecting, from the plurality of reference audio inputs, the reference audio input having the highest energy for comparison to the main audio input.

* * * * *